United States Patent [19]

Inoue

[11] 4,423,587

[45] Jan. 3, 1984

[54] DOUBLE TWISTING FRAME FOR FLANGE BOBBIN

[75] Inventor: Yoshihisa Inoue, Ibaragi, Japan

[73] Assignee: Murata KiKai Kabushiki Kaisha, Japan

[21] Appl. No.: 263,789

[22] Filed: May 14, 1981

[30] Foreign Application Priority Data

May 14, 1980 [JP] Japan ..... 55-66774

[51] Int. Cl.[3] ..... D01H 7/86

[52] U.S. Cl. ..... 57/58.86; 57/58.83

[58] Field of Search ..... 57/58.49, 58.7, 58.83, 57/58.84, 58.86

[56] References Cited

U.S. PATENT DOCUMENTS

| | | | |
|---|---|---|---|
| 2,492,581 | 12/1949 | Kingsbury | 57/58.86 |
| 2,571,109 | 10/1951 | Carter et al. | 57/58.86 X |
| 2,613,886 | 10/1952 | Roberts | 57/58.86 X |
| 2,699,032 | 1/1955 | Landolt | 57/58.86 |
| 2,731,787 | 1/1956 | Marsh | 57/58.86 |
| 2,932,150 | 4/1960 | Keith | 57/58.86 |
| 3,490,221 | 1/1970 | Heimes et al. | 57/58.86 |

*Primary Examiner*—John Petrakes

*Attorney, Agent, or Firm*—Barnes, Kisselle, Raisch, Choate, Whittemore & Hulbert

[57] ABSTRACT

A double twisting frame for a flange bobbin, in which a yarn unwound from a yarn supply bobbin is guided to a central hole of the bobbin, passed through a tension device and a yarn guide hole wound on the periphery of a rotary board, then travelled upward, and then twisted while being ballooned. A flyer is rotatably mounted on the upper side of the yarn supply bobbin and the flyer has a yarn guide portion located outwardly of the peripheral surface of the upper flange of a flange bobbin.

4 Claims, 2 Drawing Figures

DOUBLE TWISTING FRAME FOR FLANGE BOBBIN

BACKGROUND OF THE INVENTION

In an ordinary double twister, a yarn unwound from a yarn supply bobbin is guided to the central hole of the bobbin from the top end of the bobbin, passed through a tension device and a yarn guide hole extended from the center of a rotay board in the radial direction, wound on the periphery of the rotary board with a certain angle, then travelled upward, twisted while being ballooned, and then wound on a winding package through a yarn guide and a winding tension adjusting device.

In this double twister, if the yarn to be twisted is a loosely twisted filamentary yarn having a hard nerve, such as that of acetate fibers, the yarn is in the state where the yarn is wound on a flange bobbin having flanges formed in the upper and lower portions thereof. Accordingly, as the thickness of the yarn layer on this bobbin is decreased, the yarn being wound is travelled while having contact with the top end flange, and if the travelling speed of the yarn is high, fluffs are readily formed, especially in the portion falling in contact with the flange. Since the yarn is loosely twisted, formed fluffs are not included into the yarn by twisting and these fluffs are present on the resulting wound yarn.

Furthermore, in the case where the unwound yarn is guided through an inner circumferential face of a tension ring mounted on the top end portion of the bobbin from the top end of a hollow shaft supporting said tension ring to a central hole of the bobbin, since a filamentary yarn such as mentioned above is travelled upwardly while having contact with the inner circumferential face of the tension ring, the tension ring is moved in the vertical direction according to changes of the unwinding tension, and fluffs are readily formed by contact of the filamentary yarn with the inner circumferential face of the tension ring.

SUMMARY OF THE INVENTION

The present invention relates to a double twisting frame. More particularly, the present invention relates to a double twisting frame suitable for twisting a filamentary yarn wound on a flange bobbin.

An object of the present invention is to provide a double twister provided with a flange bobbin in which a yarn being wound from a yarn supply bobbin with a flange is travelled without falling in contact with the upper flange so that fluffs are not formed at all and a yarn having a high quality can be obtained.

In accordance with the present device, there is provided a double twister for a flange bobbin, which comprises a flyer rotatably mounted on a hollow shaft inserted in a central hole of an upper flange of the flange bobbin mounted on a stationary board of the double twister, said flyer having a yarn guide portion located outwardly of the peripheral surface of the upper flange of said flange bobbin, a disc-like top guide disposed on the top end portion of said hollow shaft, said disc-like top guide having a central hole contiguous to the central hole of said hollow shaft, and a tension device including a disc-like weight plate placed on the top face of said top guide, wherein a yarn which has passed through the top face of the top guide and the lower face of the weight plate is immediately travelled downward from the central hole of the top guide through the hollow shaft.

DETAILED DESCRIPTION OF THE INVENTION

The present invention will now be described in detail with reference to an embodiment illustrated in the accompanying drawings.

Figure 1:
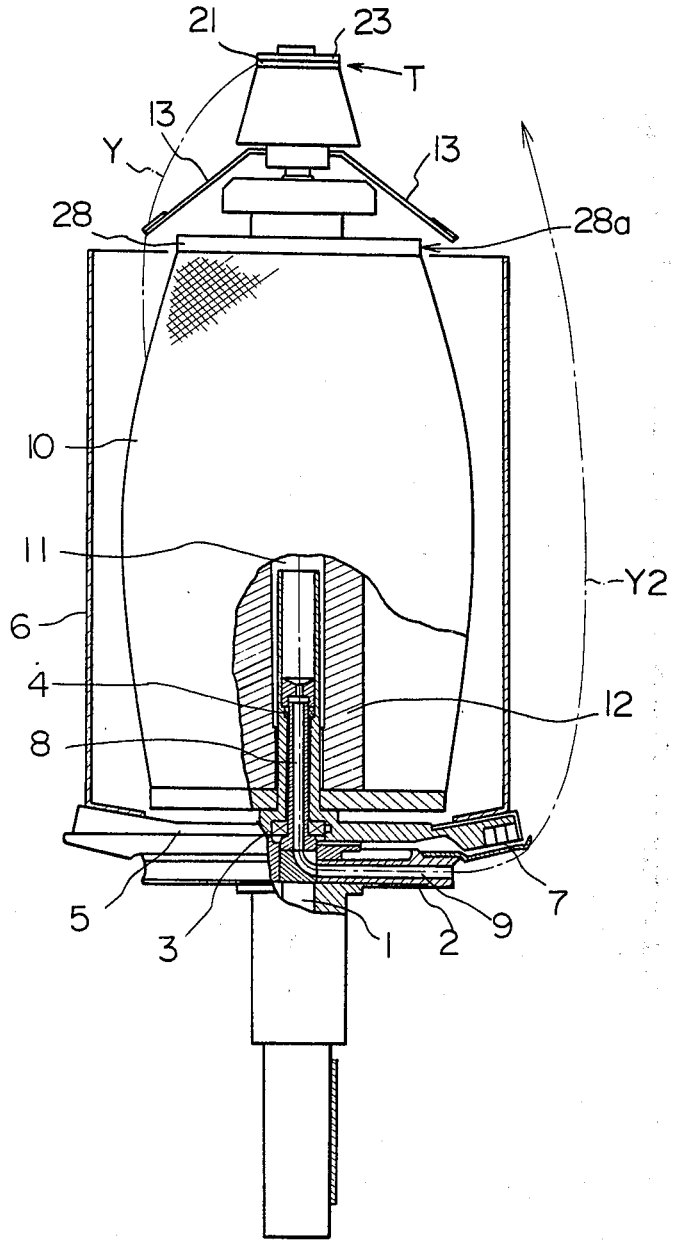
FIG. 1 is a partially sectional front view illustrating one embodiment of the double twister of the present invention.

Referring to FIG. 1, a rotary board 2 is fitted and fixed to a rotary spindle 1, and a stationary board 5 is freely supported around the spindle 1 through bearings 3 and 4. A yarn supply pot 6 is placed and fixed onto the stationary board 5 and a yarn supply bobbin 10 is set on the pot 6. A magnet 7 is secured to the stationary board 5 so that the stationary board 5 is fixed at a predetermined position by this magnet 7 and an external magnet.

A yarn passage hole 8 is formed at the center of the spindle shaft 1, and a yarn guide hole 9 is formed so that is contiguous to the center of the rotary board 2 and extended in the radial direction from the center of the rotary board 2. A yarn Y unwound from the yarn supply bobbin 10 is guided to a central hole 11 of the bobbin through a tension device T located in the upper portion of the bobbin, passed through the yarn passage hole 8 of the spindle shaft 1 and introduced outside through the yarn guide hole 9 of the rotary board 2. Then, the yarn Y is wound on the peripheral face of the rotary board with a certain angle to absorb variations of the tension, and then, the yarn Y is travelled upward while forming a balloon Y2 under a certain ballooning tension.

The yarn supply bobbin 10 is supported on the stationary board 5 and the yarn is wound on a flange bobbin 12. The tension device T and a flyer 13 are placed on the top end of the bobbin 12.

Figure 2:
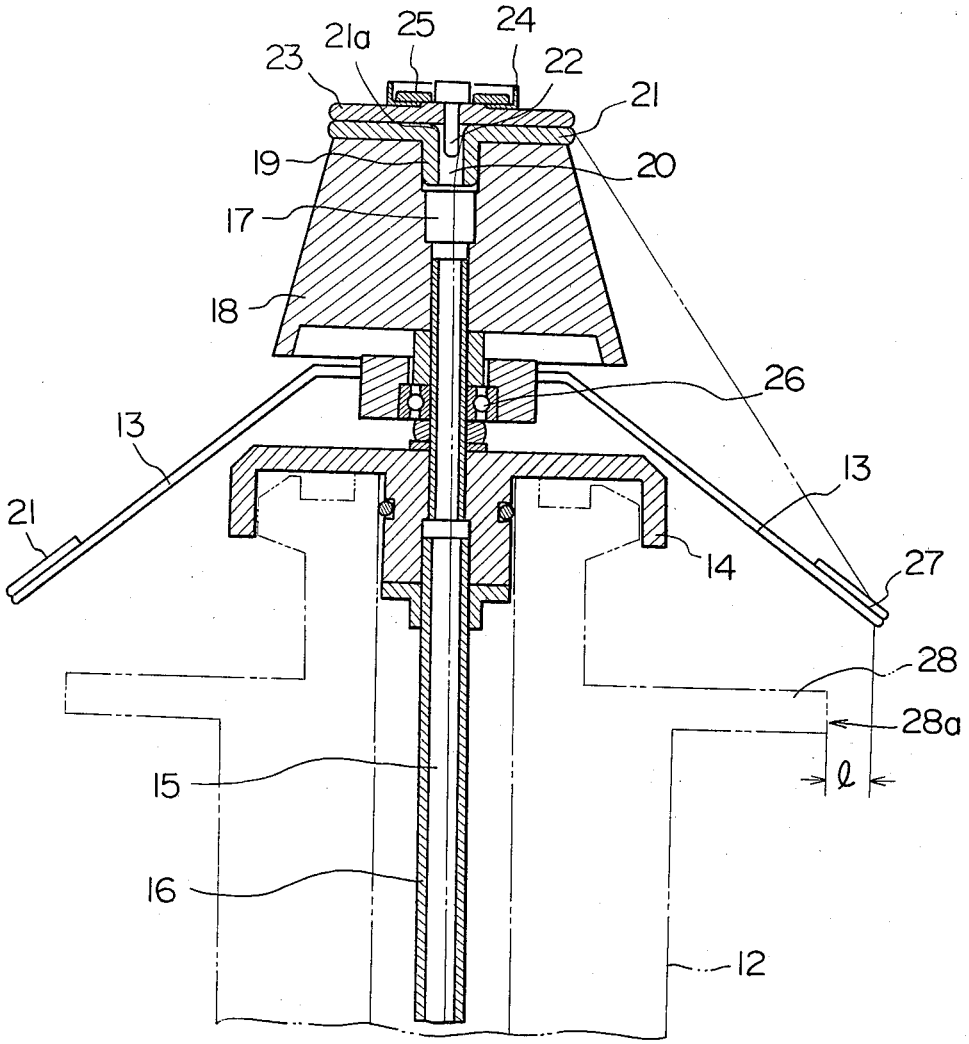
FIG. 2 is a sectional front view showing the main portion of the apparatus shown in FIG. 1.

Referring to FIG. 2, a hollow shaft 16 having a central hole 15 is fixed to a supporting member 14 mounted on the flange bobbin 12, and a tensor proper 18 having a central hole 17 is screwed or fitted to the top end portion of the shaft 16.

A disc-like top guide 21 formed of a hard material such as titanium and having a central hole 20 in a projection 19 is secured to the top face of the tensor proper 18, and the top face of the top guide 21 is flattened so that the top face of the top guide 21 has line contact with the yarn being passed. A disc-like weight plate 23 fixed to a pin 22 is mounted on the top guide 21. A weight case 24 and a weight 25 are fixed to the weight plate 23 so that an appropriate pressing force is applied to the yarn passed between the weight plate 23 and the top guide 21. The weight plate 23 is formed of the same material as that of the top guide 21, and it may be exchanged with another weight plate differing in the diameter according to the kind and thickness of the yarn.

A pair of flyers 13 are supported on the shaft 16 through a bearing 26 rotatably around the shaft 16, and the length of the flyers 13 is determined so that yarn guide portions 27 on the top ends of the flyers 13 are located outwardly of the peripheral face 28*a* of the upper flange 28 by a length of at least *l*. The flyers 13 are rotated in the yarn-unwinding direction when the yarn is unwound from the bobbin. Accordingly, the unwound yarn is prevented from rising along the periphery of the yarn layer on the yarn supply side. Namely, the yarn separated from the surface of the yarn layer is immediately travelled toward the yarn guide portions 27 of the flyers without falling in contact with the yarn layer.

Accordingly, in FIG. 1, the yarn Y unwound from the yarn supply bobbin 10 is introduced between the top guide 21 and the weight plate 23 through the flyers 13, travelled downward through the central hole 17 of the bobbin and then travelled upward under a certain ballooning tension through the spindle shaft 1 and the yarn guide hole 9 of the rotary board 2.

Even when the thickness of the yarn layer of the yarn supply bobbin is reduced and the outermost portion of the yarn later is located on the inner side than the peripheral face 28*a* of the upper flange 28, the travelling course of the unwound yarn is regulated by the flyers 13 and the yarn is guided to the weight plate without falling in contact with the upper flange 28. Furthermore, the yarn passing between the top guide 21 and the weight plate 23 is travelled while having line contact with the planes of the top guide 21 and weight plate 23, and the yarn is guided from the central hole 21*a* of the top guide to the yarn passage hole located below.

Accordingly, when a loosely twisted filamentary yarn having a hard nerve and tending to slip, such as a filamentary yarn of acetate fibers, which is wound on the flange bobbin, is unwound in the state where the wound yarn is vertically held on the stationary board, the yarn is unwound from the surface of the yarn layer by the flyers 13 as if the yarn were peeled from the surface of the yarn layer. Accordingly, upward movement of the filamentary yarn along the peripheral face of the yarn layer, which is observed in the conventional apparatus, is not caused, and therefore, a so-called ring separation phenomenon, that is, simultaneous separation of the yarn corresponding to one circle of the bobbin from the yarn layer, does not occur and the yarn is regularly unwound. Furthermore, since the yarn guide portions of the flyers are located outwardly of the peripheral face of the upper flange 28 of the bobbin and turned around the bobbin, the unwound yarn is prevented from falling in contact with the upper flange, and therefore, even if a loosely twisted filamentary yarn such as mentioned above is used, fluffs are not formed at all.

The yarn which has passed through the yarn guide portions 27 of the flyers 13 is guided between the top guide 21 fixed to the top face of the tensor proper located in the upper portion of the bobbin and a weight plate 23 mounted on the top guide 21, and the yarn is immediately travelled from the central hole 21*a* of the top guide 21 downward, that is, toward the central hole of the shaft 16 inserted in the central hole of the bobbin. Accordingly, the weight plate 23 does not undergo any force pushing up the weight plate 23, and even if the unwinding tension is changed, since the lower face of the weight plate 23 has line contact with the yarn, the weight plate 23 is prevented from having point contact with the yarn and formation of fluffs is prevented.

The above-mentioned double twister comprising the tension device and flyers as described above is especially effective when a filamentary yarn of acetate fibers or the like is treated, but the double twister may be applied to the treatment of other filamentary yarns.

As will be apparent from the foregoing description, the double twister of the present invention is characterized in that a flyer is disposed in the upper portion of a flange bobbin mounted on a stationary board of the double twister so that the flyer can freely rotate on the upper portion of a hollow shaft inserted in a central hole of the bobbin, a yarn guide is formed on the flyer outwardly of the periphery of the upper flange of the flange bobbin, a tensor proper including a disc-like top guide having a central hole is fixed to the top end portion of the hollow shaft, a disc-like weight plate is mounted on the top face of the top guide and a yarn which has passed through the plane between the top guide and the weight plate is immediately travelled downward through the interior of the hollow shaft. By virtue of these characteristic features, in the double twister of the present invention, even when the outermost surface of the yarn layer on the flange bobbin is on the inner side than the periphery of the upper flange of the bobbin, the yarn is travelled without falling in contact with the upper flange and in the tension device, the yarn is caused to fall in contact only with the lower face of the weight plate. Accordingly, even when a loosely twisted filamentary yarn of acetate fibers or the like having a hard nerve is treated, fluffs are not formed at all and a yarn having a high quality can be obtained.

What is claimed is:

1. In combination a double twister having a top end and an axis of rotation and including a rotatable spindle having an axis of rotation on the axis of rotation of the double twister, a rotary board having an axis of rotation congruent with the axis of rotation of the spindle one side of which is secured to the spindle for rotation therewith and having a yarn passage extending first axially from the other side thereof and then radially through the outer periphery thereof, a first hollow shaft secured to the rotary board on the axis of the spindle extending from the other side of the rotary board, the inside of which is in communication with the yarn passage in the rotary board, a stationary board sleeved over the first shaft, means operable between the first shaft and rotary board for permitting relative rotation therebetween, said stationary board including means for mounting a flange bobbin on the axis of rotation of the spindle, and a cylindrical yarn supply pot having a lower end secured to the stationary board and an upper end for receiving a yarn supply flange bobbin positioned therein on the axis of rotation of the spindle, a tensor positioned in spaced relation to the top end of the double twister for receiving yarn unwound from a flange bobbin placed in the double twister and providing a tension on the yarn as it proceeds axially downwardly through the double twister on the axis thereof and a flyer rotatably mounted on the axis of the double twister between the tensor and the double twister including means for guiding the yarn past the upper flange of a flange bobbin placed in the double twister as it passes between the flange bobbin in the double twister and the tensor whereby fluffs are not formed in the yarn.

2. Structure as set forth in claim 1, wherein the tensor structure includes a supporting member adapted to be mounted on the upper flange of a flange bobbin positioned in the yarn supply pot on the double twister structure, a second hollow shaft secured to the supporting member on the axis of the spindle in assembly, a tensor body member secured on the second shaft having an opening therein in communication with the interior of the second shaft, a disc-like top guide constructed of hard material having a central hole therein secured to the tensor body member over the top thereof with the central hole aligned with the axis of the spindle in assembly, a disk-like weight plate positioned on top of the top guide, a pin extending through the weight plate and into the central hole of the top guide, a weight case secured on top of the weight plate and a weight positioned within the weight case.

3. Structure as set forth in claim 2, wherein the flyer comprises an annular member sleeved over the second hollow shaft between the supporting member and the tensor body member, bearings mounting the annular member on the hollow shaft for rotation relative thereto and at least one flexible linear member extending radially outwardly from the annular member and secured thereto at one end having yarn guide means at the radially outer end thereof.

4. Structure as set forth in claim 3, wherein the yarn guide means is positioned radially outwardly of the top flange of a flange bobbin positioned in the double twister whereby yarn unwound from the flange bobbin is maintained out of contact with the upper flange of the flange bobbin.

* * * * *